US007048653B2

(12) United States Patent
Heimers

(10) Patent No.: US 7,048,653 B2
(45) Date of Patent: May 23, 2006

(54) BALL RETRIEVAL DEVICE FOR BALL GAMES, PARTICULARLY FOR TENNIS RACKETS

(76) Inventor: Friedreich O. Heimers, 3925 Rogers Rd., Spring Valley, CA (US) 91977

( * ) Notice: Subject to any disclaimer, the term of this patent is extended or adjusted under 35 U.S.C. 154(b) by 130 days.

(21) Appl. No.: 10/717,499

(22) Filed: Nov. 21, 2003

(65) Prior Publication Data

US 2004/0127307 A1 Jul. 1, 2004

(30) Foreign Application Priority Data

Nov. 25, 2002 (CH) ..... 1977/02

(51) Int. Cl.
*A63B 69/38* (2006.01)
*A63B 69/00* (2006.01)

(52) U.S. Cl. ..... 473/424; 473/423; 473/459; 473/463

(58) Field of Classification Search ..... 473/422, 473/424, 425, 450, 458, 464, 506–508, 521, 473/459, 463
See application file for complete search history.

(56) References Cited

U.S. PATENT DOCUMENTS 2,094,536 A 9/1937 Heimers
2,128,610 A * 8/1938 Heimers ..... 473/425
2,806,700 A * 9/1957 Heimers et al. ..... 473/425
2,945,694 A * 7/1960 Heimers et al. ..... 473/576
2,945,695 A * 7/1960 Heimers et al. ..... 473/425
3,065,563 A * 11/1962 Bascom ..... 43/19
3,168,312 A * 2/1965 Davis ..... 473/423
3,635,475 A * 1/1972 Brown ..... 473/425
3,735,934 A * 5/1973 Black ..... 242/387
3,876,162 A * 4/1975 Chun et al. ..... 473/142
4,023,797 A * 5/1977 Sarrasin ..... 473/425
4,753,442 A * 6/1988 Bland ..... 473/424
4,784,389 A * 11/1988 Taylor ..... 473/425

FOREIGN PATENT DOCUMENTS

BE 413044 1/1936
GB 205524 10/1923
GB 491536 9/1938

* cited by examiner

*Primary Examiner*—Mitra Aryanpour
(74) *Attorney, Agent, or Firm*—Young & Thompson

(57) ABSTRACT

A ball retrieval device, particularly for integration in a tennis racket, includes a rotatable spool with a longitudinally displaceable carriage arranged thereon. Through rotation of the spool, a rubber-elastic thread element can be wound up on the latter or unwound therefrom, the carriage providing a well-tuned process with maximum compactness of the turns. To this end, the surface of the spool is provided with a helical groove in which the thread element is laid.

7 Claims, 8 Drawing Sheets

FIG. 15
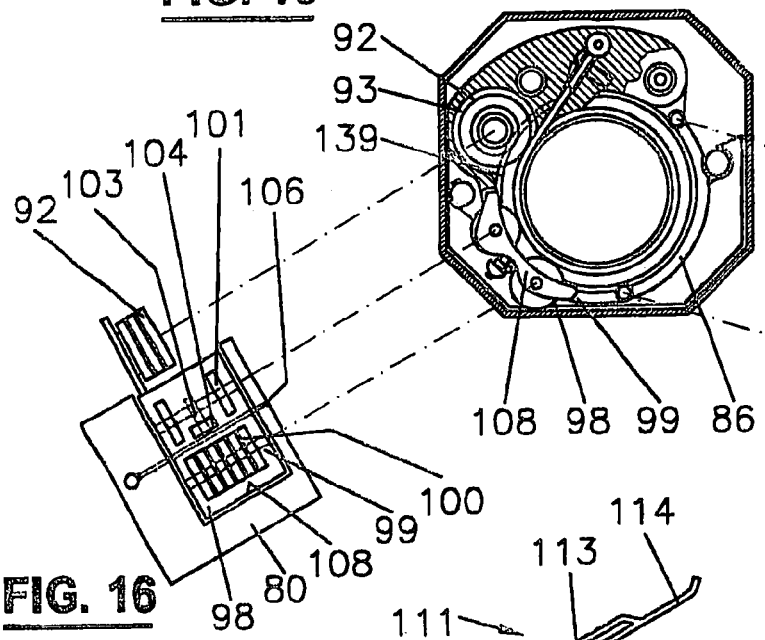
FIG. 22
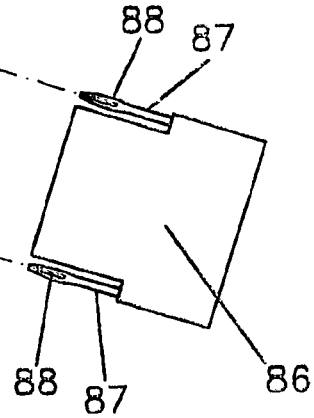
FIG. 16
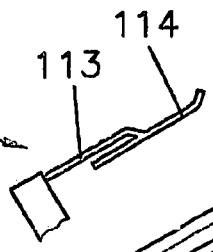
FIG. 21
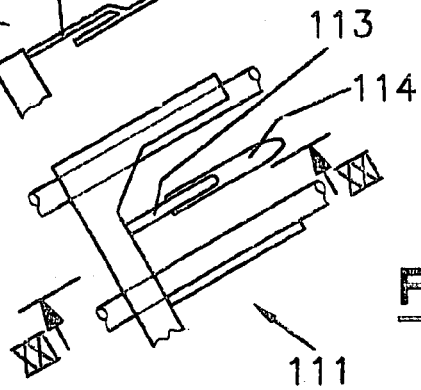
FIG. 20
FIG. 14
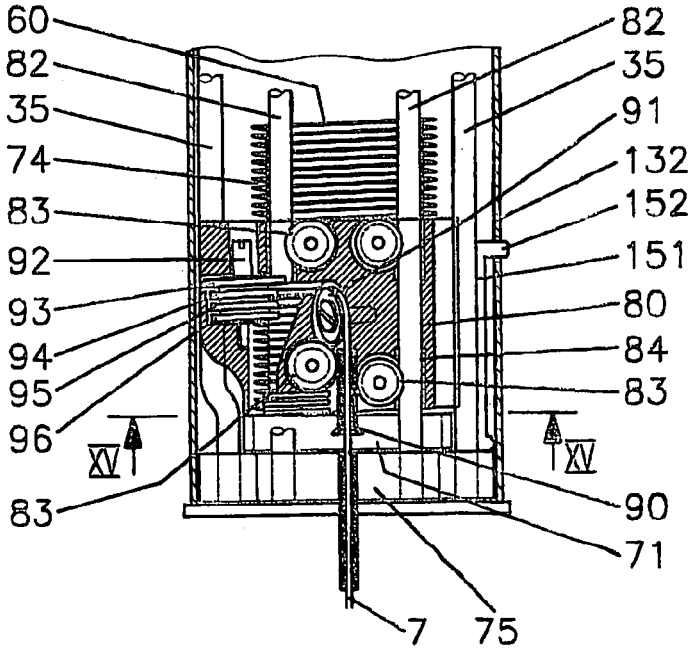

BALL RETRIEVAL DEVICE FOR BALL GAMES, PARTICULARLY FOR TENNIS RACKETS

FIELD OF THE INVENTION

The present invention relates to a ball retrieval device for ball games where a playing ball is attached to a rubber-elastic thread element, more particularly a rubber thread.

Different executions of ball retrieval devices are known in the art. The purpose is that the player may throw or drive away the ball and the latter is automatically retrieved, thereby eliminating the need of pursuit and search and allowing a game "with oneself". Naturally, a requirement of such retrieval devices is that the ball game itself is not or at least not substantially disturbed.

PRIOR ART

A tennis racket having rubber threads stretched in front a racket surface in a harp-like manner is e.g. known from Mexican Patent No. MX-A-36717. The rubber thread, whose end is attached to the ball, is guided several times from the handle to the tip of a racket and back over pulleys. When the ball is hit, the rubber is stretched and its extension is distributed over the entire length of the thread, thereby allowing a relatively long flight of the ball. To this end, however, the rubber thread must be guided on the pulleys very smoothly but nevertheless precisely, thereby resulting in high demands with respect to the rubber thread.

In addition, the harp of rubber threads arranged on one side of the racket is disadvantageous as it substantially excludes the use of that side for playing.

SUMMARY OF THE INVENTION

Therefore, an object of the present invention consists in providing a ball retrieval device for use with an elastically extensible thread element, more particularly a rubber thread, including an improved guidance of the rubber thread.

This is accomplished by a device wherein said rubber thread is retained in a thread storage device comprising the following parts:

- a spool including a recovery element capable of being tensioned through rotation of the spool,
- a carriage that is displaceable in the longitudinal direction of the spool, including a device for guiding said rubber thread, and
- a driving device of the carriage that is operatively connected to said spool in order to move the carriage in synchronicity with the rotational movement of said spool, such that the rubber thread wound up on said spool is capable of being unwound while tensioning said recovery element and of being automatically rewound on said spool while releasing the tension of said recovery element, the winding operation being controllable by said guiding device in said carriage.

Preferred executions and applications are the object of the further claims.

Accordingly, the ball retrieval device of the invention comprises a spool on which the elastic thread element, more particularly a rubber thread, is wound and unwound. The spool is turned as it is unwound, and a recovery element is simultaneously tensioned. For a disturbance-free, reproducible operation, it has turned out to be important that the rubber thread is wound up on the spool in a controlled manner in spite of its elastic properties which lead to its contraction when rewound. For this purpose, the following two measures have been successful:

A) The surface of the spool is provided with a spiral helix in whose turns the rubber thread is laid.

B) A carriage comprising a guiding device for the rubber thread is provided that guides the thread as precisely as possible onto the contact point on the spool surface, particularly while it is wound up, and that is longitudinally displaced synchronously with the rotation of the spool.

Preferred embodiments of the device include further features, in particular:

- The carriage also effects a deflection of the thread run to a direction essentially parallel to the spool axis.
- A spool brake is provided which is activated by the carriage when the latter goes past its normal end position during take-up, e.g. in the event of a torn thread.
- The retrieval device is incorporated in the handle of a tennis racket, the rubber thread running freely from the retrieval device over a racket surface to a guiding device in the racket tip.
- The end on the ball side of the rubber-elastic thread element or rubber thread includes a swivel taking up a rotational movement of the ball, e.g. in the case of sliced balls, thereby preventing a twisting of the rubber thread that might cause disturbances inside the retrieval device.

BRIEF DESCRIPTION OF THE DRAWING

The invention shall be further explained with reference to a preferred exemplifying embodiment and to figures. The figures show:

FIG. 14 top view of carriage in foremost position;

FIG. 15 front view of carriage, spool sectioned according to XV—XV in FIG. 14;

FIG. 16 partial view of carriage: roller carriage;

FIG. 20 projection of the clasp;

FIG. 21 cross-section of the clasp according to XXI—XXI in FIG. 2

FIG. 22 plan view of the closure slide;

DETAILED DESCRIPTION OF THE INVENTION

Figure 1:
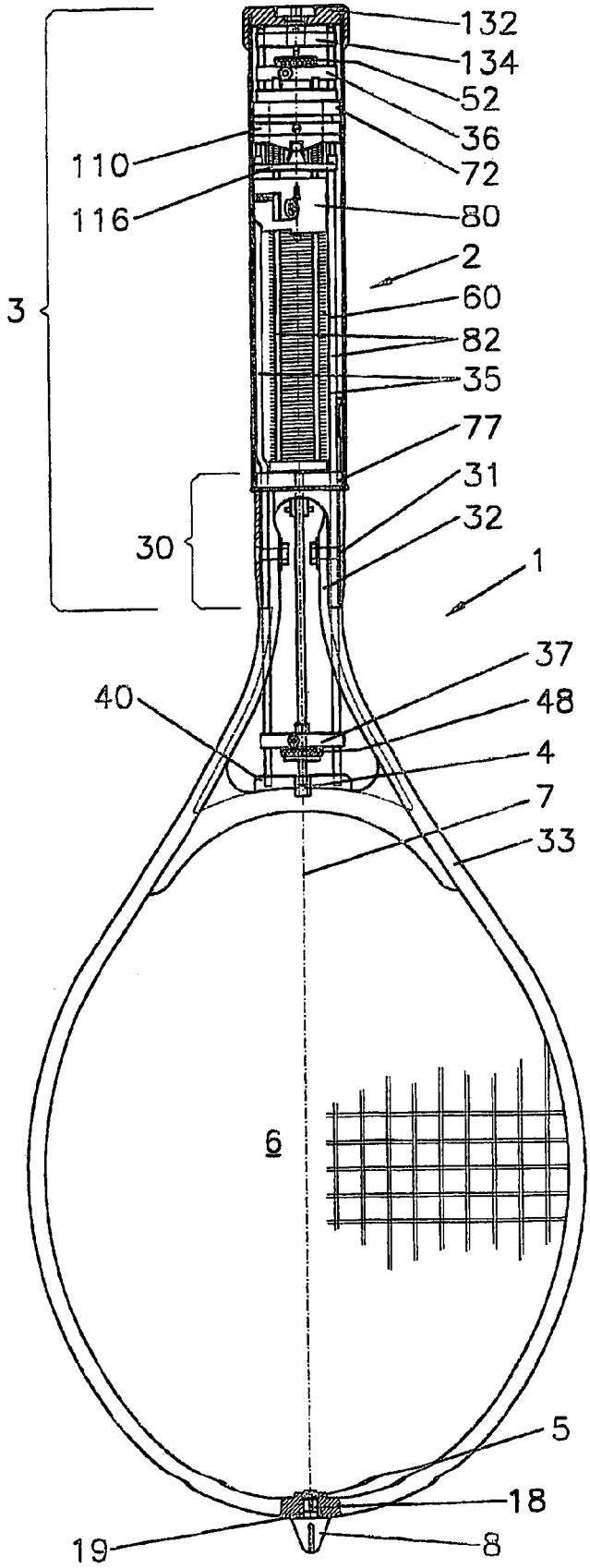
FIG. 1 plan view of a tennis racket including a ball retrieval device with the handle and portions of the frame open or sectioned.
Figure 2:
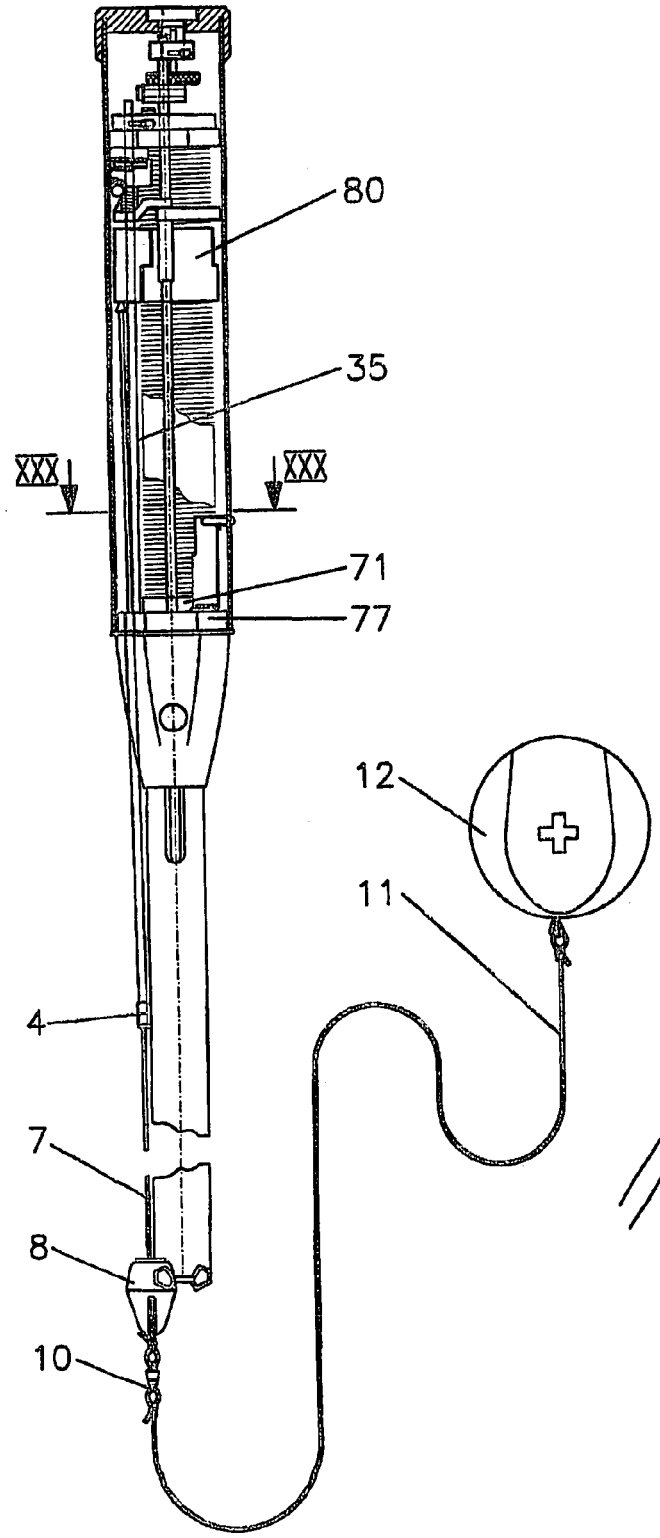
FIG. 2 same as FIG. 1, but in side elevation, with thread and ball.
Figure 3:
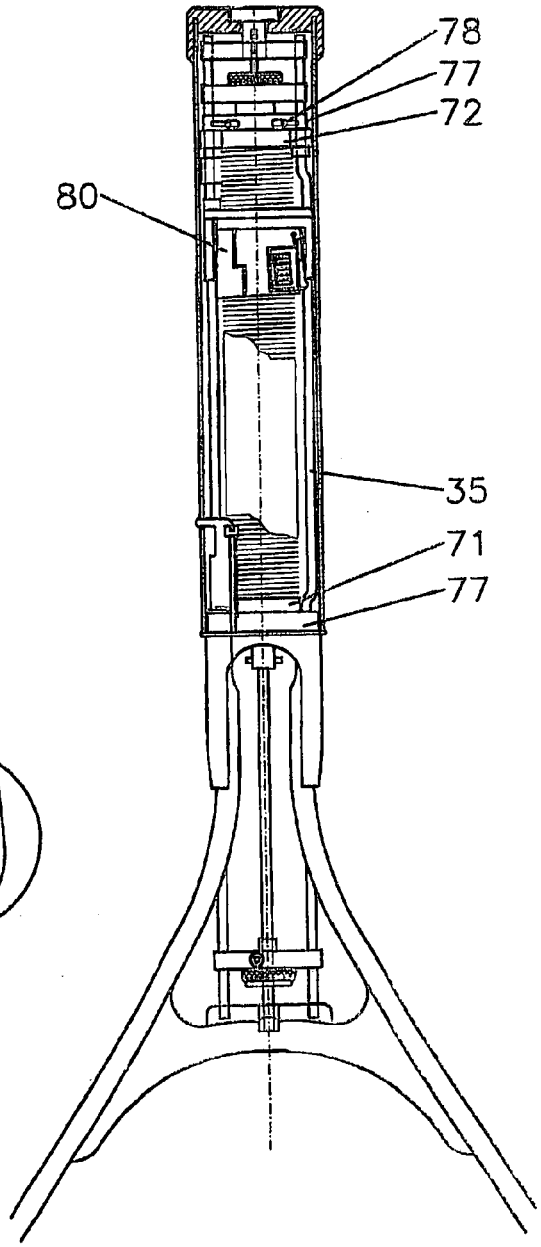
FIG. 3 bottom view of the handle portion of tennis racket of FIG. 1.
Figure 4:
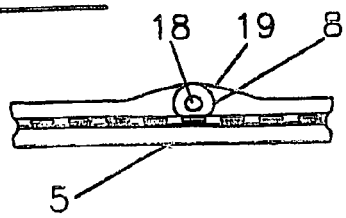
FIG. 4 partial view on the tip of the tennis racket.

The main mechanism 2 of a ball retrieval device according to the invention is integrated in handle 3 of a tennis racket 1 (see particularly FIGS. 1 to 5). Rubber thread 7 runs from exit guide 4 of main mechanism 2 to the tip 5 of racket-head 6. Rubber thread 7 passes through a smooth-running swivel-head 8 that is rotatably attached to tip 5. The end of rubber thread 7 has a swivel 10 attached thereto, followed by another thread 11 to which ball 12 is fastened. Thread 11 may also consist of a rubber-elastic material like rubber thread 7, or it may alternatively be essentially inextensible (see FIG. 2).

In addition to its main function, i.e. to prevent the transmission of rotational movements of ball 12 to rubber thread 7, swivel 10 further serves as a stop for rubber thread 7 during the retrieval of ball 12. Thread 11 defines a minimum thread length allowing e.g. to throw up ball 12 for a serve.

Figure 5:
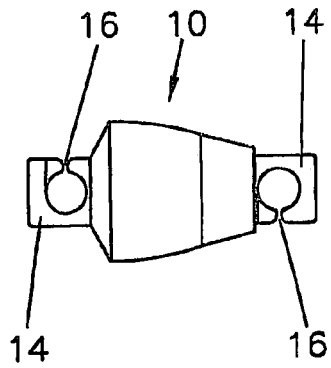
FIG. 5 side view of a swivel.
Figure 6:
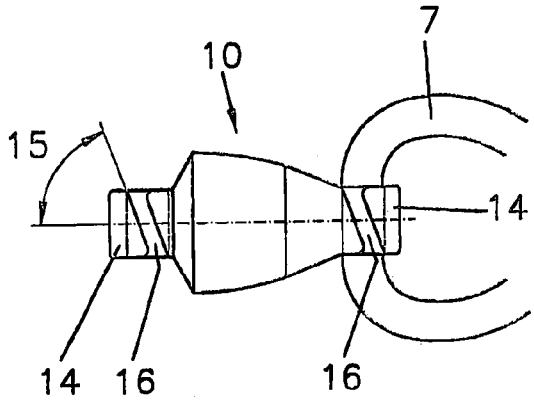
FIG. 6 front view of a swivel with the end of a rubber thread inserted therein.

Details of swivel 10 and of the attachment of the thread to the swivel are shown in FIGS. 5 and 6. The swivel is essentially of the type known e.g. from sportfishing. For an easy introduction of a rubber thread 7, eyes 14 are provided with a slot 16 at an angle 15 of approx. 60° with respect to the longitudinal axis of swivel 10. The width of the slot amounts to approx. a third of the diameter of rubber thread 7. The oblique arrangement of slot 16 and its narrow design safely prevent a disengagement of rubber thread 7. If an inextensible material is chosen for leader 11, it is generally impossible to introduce the latter through slot 16, so that a loose end must be threaded through eye 14.

Figure 7:
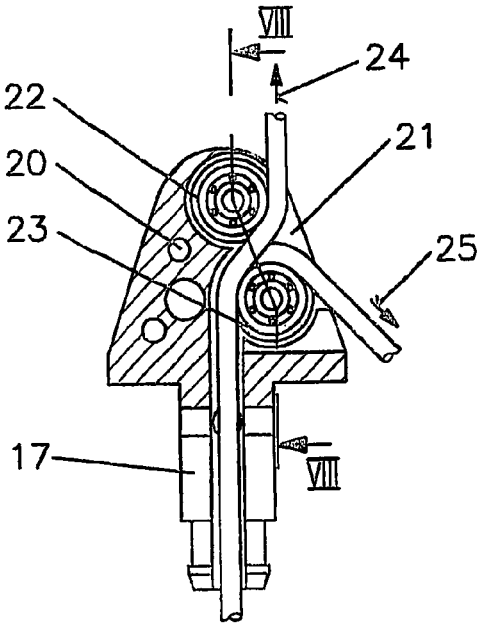
FIG. 7 longitudinal section of a swivel head.
Figure 8:
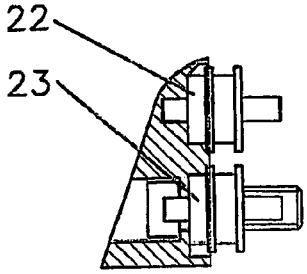
FIG. 8 cross-section according to VIII—VIII in FIG. 7 through the left half of a swivel head.
Figure 9:
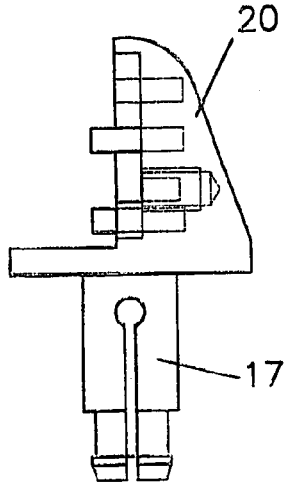
FIG. 9 projection of the right half of the swivel head according to IX in FIG. 7.

Shaft 17 of swivel head 8 smoothly rotates in a through-going bore 18 in reinforcement 19 at the tip 5 of racket 1. (FIG. 4, FIGS. 7 to 9). Rubber thread 7 passes through hollow shaft 19 and into head 20 of swivel head 8 and exits from the side of head 20 through exit 21. Exit 21 is provided with upper and lower guiding pulleys 22, 23. Pulleys 22, 23 are smoothly journalled, particularly by means of ball bearings. The ball bearings are encased to prevent the penetration of dust. As illustrated in FIG. 7, guiding pulleys 22, 23 keep rubber thread 7 from gliding over stationary parts of head 20 even in the indicated extreme exiting directions (arrows 24, 25), thereby eliminating the risk of wear.

Thus, due to the rotating ability of swivel-head 8 around the longitudinal axis of the racket and the laterally arranged outlet 21 provided with guiding pulleys 22, 23, an extremely wear-free guidance of rubber thread 7 is obtained almost independently from the direction in which the rubber thread is drawn out of swivel-head 8 or enters the latter, respectively.

Main mechanism 2 of the ball retrieval device is implemented as a tennis racket handle and fastened to racket head 6 via an adapter 30. Two screws 31 extend laterally through adapter 30 into elongations 32 of the frame 33 of head 6. Two longitudinal support bars 35 extend through screws 31 from a rear support plate 36 to a front support plate 37 (see FIGS. 1 to 3 and FIGS. 10 to 12, inter alia).

Figure 11:
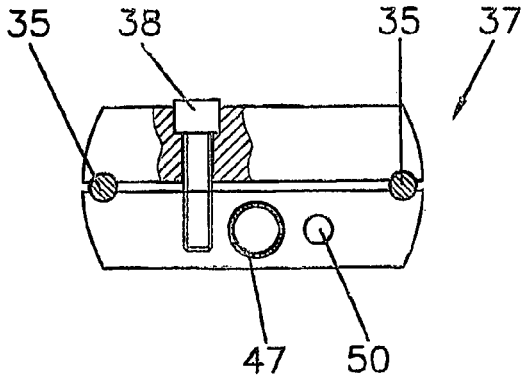
FIG. 11 projection of front support plate according to XI in FIG. 10.
Figure 12:
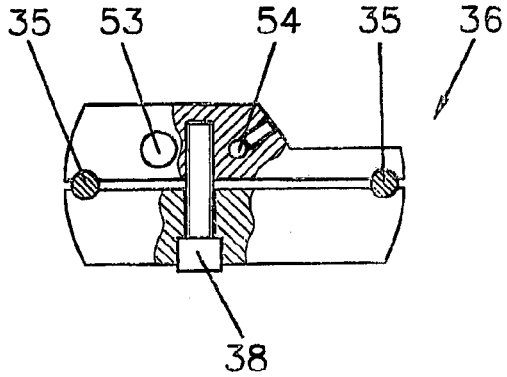
FIG. 12 projection of rear support plate according to XII in FIG. 10.

However, other solutions are also conceivable here, such as e.g. longitudinal supports extending around screws 31, or a part in each longitudinal support. The part is provided with an oblong hole through which respective screws may extend. As shown in FIGS. 11 and 12, the front and rear support plates 37, 36 consist of two respective halves which are pressed together by a screw 38 and are thus retained on the longitudinal supporting bars as well.

The front ends of longitudinal supporting bars 35 are retained in blind holes 39 in a support plate 40. Support plate 40 rests on frame 33 of racket-head 6 and supports main mechanism 2 on frame 33. Furthermore, guide 4 for rubber thread 7 is mounted on support plate 40.

Figure 10:
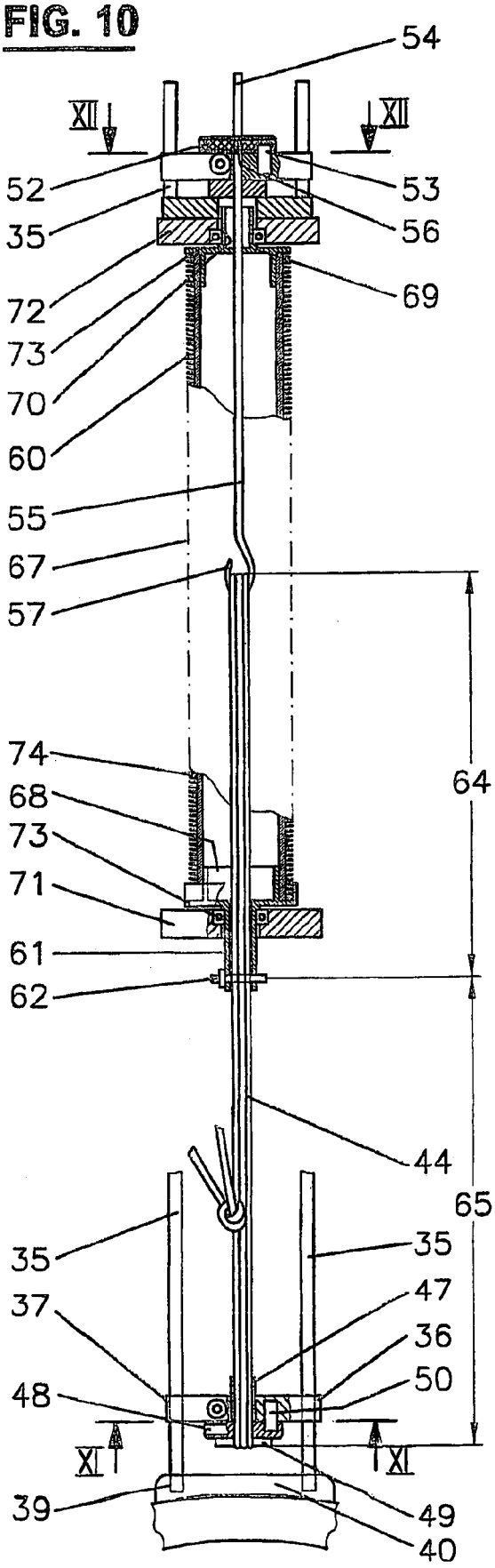
FIG. 10 Driving system of the retrieval device, longitudinal section, reduced to driving elements.

At the front end, the rubber thread of rubber drive 44 is stuck through the hollow shaft 47 of knurled wheel 48 in front support plate 37 and retained by pin 49 (FIGS. 10, 11). Knurled wheel 48 rests on front support plate 37 and is provided at the bottom with a hole or preferably a plurality of holes for a fixation pin 50 inserted in front support plate 37. Knurled wheel 48 is pressed against front support plate 37 by the tension of rubber drive 44 and immovably retained in predetermined positions by fixation pin 50 which engages in a hole in knurled wheel 48.

Rubber drive 44 consists of a rubber band or rubber thread which is knotted together to form a triple loop.

In the rear part of racket handle 3, another combination of a second knurled wheel 52 and another fixation pin 53 is provided, fixation pin 53 being inserted in rear support plate 36. Knurled wheel 52 holds the shaft 54 of a hook 55 which is retained by a clamping screw 56. Rubber drive 44 is attached to the curved front portion 57 of hook 55. Spool 60 for receiving rubber thread 7 comprises an elogation 61 having a driving pin 62 inserted therein. The strands of rubber drive 44 extend on either side of driving pin 62 and can thus impart a torque to the driving pin when spool 60 is rotated with respect to rubber drive 44. It has been found that for the smoothest possible operation of the spool, it must be prevented that axial forces may act upon the bearings of spool 60 when rubber drive 44 is tensioned. This is accomplished in that during the attachment of the rubber drive, hook 55 is displaced in rear knurled wheel 52 in such a manner that the distance between the end of rubber drive 44 on the side of hook 55 and driving pin 62 corresponds to the distance 65 between driving pin 62 and the end of rubber drive 44 on the side of front knurled wheel 48. In other words, hook 55 has to be adjusted such that its front end 57 is exactly at the same distance from driving pin 62 as pin 49, the latter distance 65 being determined by construction.

Figure 13:
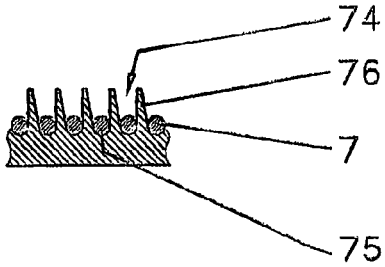
FIG. 13 partial section: helical groove on spool.

Spool 60 is essentially formed of spool jacket 67 with a front end piece 68 and a rear end piece 69 inserted therein. Front end piece 68 forms elongation 61, and rear end piece 69 forms a similar elongation 70, only shorter. Elongations 61 and 70 project into corresponding recesses in front bearing plate 71 and rear bearing plate 72 and are smoothly journalled therein by means of rolling bearings 73, particularly ball bearings. Spool jacket 67 is provided on its surface with a helical groove 74 of which a highly enlarged partial section is shown in FIG. 13. The bottom 75 of the groove 74 is angled in order to counteract twisting of rubber thread 7 in groove 74. Practical tests have shown that a round design of groove bottom 75 results in a strong tendency of rubber thread 7 to twist and to depart from its proper position in the helical groove due to the formation of loops.

The separating walls 76 between the turns of helical groove 74 must be as thin as possible, and the radius of groove bottom 75 must be as large as possible in order to be able to roll up a maximum length of rubber thread 7 on a spool jacket 67. Correspondingly, during winding and unwinding, the rubber thread must be guided to be most precisely colinear with the course of the helical groove at the ascent point of rubber thread 7 in order to avoid that separating walls 76 are subject to wear or that rubber thread 7 skips to an adjacent groove turn across the relatively low separating wall 76.

Similarly to support plates 36, 37, bearing plates 71, 72 are pushed onto longitudinal support bars 35. At the rear and in front thereof, a respective securing plate 77 is disposed which is fastened on longitudinal support bars 35 by means of clamping screws 78 (see FIGS. 3, 18, 19).

For the guidance of rubber thread 7, a carriage 80 is provided which surrounds spool jacket 67 and is longitudinally displaceable on guide bars 82. Guide bars 82 are retained in support plates 71, 72. As appears in the enlarged illustration of FIGS. 14 and 15, carriage 80 may be displaceable on guide bars 82 e.g. by means of rollers 83.

An alternative shown in FIG. 14 consists in slide bushings 84.

In the operative condition, carriage 80 completely surrounds spool jacket 67 in order to avoid that rubber thread 7 skips to adjacent turns of helical groove 74. For threading and attaching a new rubber thread 7, the rear portion of carriage 80 is designed as a removable closure slide 86 (FIG. 22). For its attachment, the latter is pushed on from the rear while its pegs 87 are inserted in corresponding fixation holes in carriage 80. In the process, the resilient slit front ends 88, which may further comprise additional retaining means such as projections, provide a locking action in the fixation holes in carriage 80. Such measures are known per se in the art and are therefore not shown in detail.

Carriage 80 comprises a guide sleeve 90, a deflecting pulley 91, and a driving roller-block 92 for guiding rubber thread 7 to deflecting pulley 91 which deflects rubber thread 7 from the axial direction to the direction tangential to spool jacket 67 and to helical groove 74. The position of deflecting pulley 91 in the axial direction is determined by driving roller block 92. To this end, driving roller-block 92 comprises a larger first, proper driving roller 93 engaging in an empty turn of helical groove 74 and extending quite close to the bottom thereof. The further rollers 94 to 96 of driving roller block 92 engage in turns of helical groove 74 in which rubber thread 7 is present. The diameter of rollers 94 to 96 is chosen such that a small distance subsists between their edges and rubber thread 7 but that they still serve as a moving closure of helical groove 74. Particularly the second roller 94 ensures a proper winding and unwinding of rubber thread 7. Driving roller-block 92 thus provides a precise synchronicity of carriage 80 with the rotation of spool 60 so that rubber thread 7 wound up or unwound from spool 60 around deflecting pulley 91 is always very precisely colinear to helical groove 74. In the respective winding or unwinding area, the rubber thread is already subject to a certain tension, which equalizes in the course of the following one or two turns, however. In this process, besides their function in assisting the proper driving wheel 93, the further rollers 95, 96 of driving roller block 92 provide protection against an ejection of rubber thread 7.

The additional rollers 95, 96 and the resulting increase in construction length allow to provide at least two ball bearings. The risk that the rollers are canted or may oscillate is thereby substantially reduced, the lifetime of the bearings is prolonged by the load distribution and the load on the sidewalls of the helical groove is reduced.

Furthermore, with regard to the entering rubber thread 7 behind driving roller block 92, carriage 80 comprises a roller carriage 98 that is loosely disposed in a frame 99 (FIGS. 15, 16). Roller carriage 98 comprises a first and a second arrangement 100, 101 of rollers. The two arrangements 100, 101 are arranged in parallel. The first arrangement 100 comprises six rollers and the second arrangement 101 only two in order to leave space for pressure pin 103 with roller 104. Roller carriage 98 is secured against falling out by a needle 106 extending through holes in frame 99 around roller carriage 98 and through housing 108 of roller carriage 98. Normally, the rollers of roller arrangement 100, 101 therefore run in helical groove 74 with slight contact on rubber thread 7 at most. In front of rear stop plate 110, which is clamped onto guide bars 82 (see FIG. 26), a clasp 111 is found (FIGS. 20, 21). Clasp 111 comprises a tongue 113 with a shoe 114. When carriage 80 moves towards rear stop plate 110 as rubber thread 7 is being wound up, roller 104 of pressure pin 103 moves under shoe 114 and is depressed by the latter. Roller carriage 98 is thereby also pressed on spool 60, and the rollers of the two roller arrangements 100, 101 are thus pressed on the rubber thread, thereby providing an improved guidance of rubber thread 7. This is important as in this position of carriage 80, if the retrieval device is correctly adjusted, swivel 10 already contacts swivel-head 8 and rubber thread 7 is therefore tensioned while carriage 80 moves on. As soon as carriage 80 stands still, since the tension of rubber drive 44 will be smaller than that of rubber thread 7 and spool 60 is thus rotated in the unwinding direction, it will move backwards and even beyond the point where the rubber thread would be just relieved. Consequently, rubber thread 7 becomes slack, and without the improved guidance through depressed roller carriage 98, there would be a risk that the rubber thread might leave helical groove 74 and even be caught between carriage 80 and separating walls 76.

Another danger arises when rubber thread 7 is torn. Without particular measures, carriage 80 would run against rear stop plate 110 unchecked, thus creating a high risk of damaging the mechanism. The resulting damages may not only affect carriage 80 but also spool 60, which is suddenly braked by driving roller-block 92.

Figure 24:
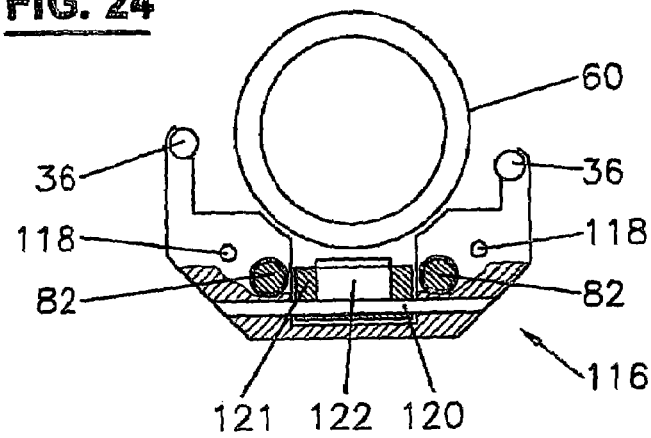
FIG. 24 cross-section according to XXIV—XXIV in FIG. 23.
Figure 23:
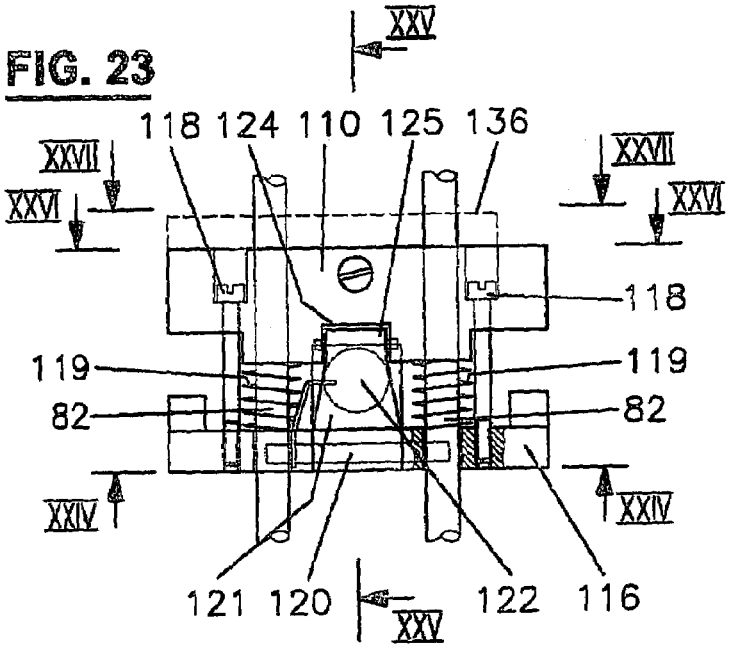
FIG. 23 plan view of the emergency brake.

In particular, on account of the resulting high lateral forces, separating walls 76 and/or the rollers of driving roller-block 92 may be damaged. Therefore, rear stop plate 110 is designed as part of an emergency brake device whose other essential component is brake support 116 (FIGS. 17 to 19; FIGS. 23 to 24). Brake support 116 is movably disposed on guide bars 82 at a distance that is determined by screws 118 which connect stop plate 110 to brake support 116. Spiral springs 119 are arranged on guide bars 82 between stop plate 110 and brake support 116. Thus, brake support 116 is movable towards stop plate 110 by compressing spiral springs 119.

Figure 25:
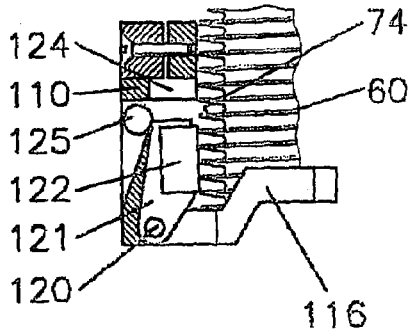
FIG. 25 cross-section according to XXV—XXV in FIG. 23.

A brake lever 121 is mounted on an axle 120 of brake support 116 which carries a brake pad 122 at its front end, e.g. of a rubber-elastic material (FIGS. 23, 25). Stop plate 110 comprises a recess 124 in which brake lever 121 may engage. At the top of the recess, a pressure roller 125 is disposed which rolls on brake lever 121 when brake support 116 moves towards stop plate 110 while simultaneously pressing the brake pad on spool 60. Thus, if rubber thread 7 is torn and carriage 80 subsequently runs against brake support 116 unchecked, the latter will move towards stop plate 110, whereby brake pad 122 is pressed on spool 60 with gradually increasing pressure. This results in a very effective braking of the spool and thus also of carriage 80, and damages of the mechanism are avoided. In particular, it has been found that the movement of brake support 116 is also exactly synchronous to that of the turns of helical groove 74, so that brake pad 122 imparts no lateral forces to separating walls 74 but exerts a braking action exactly in the longitudinal direction of the groove.

Figure 26:
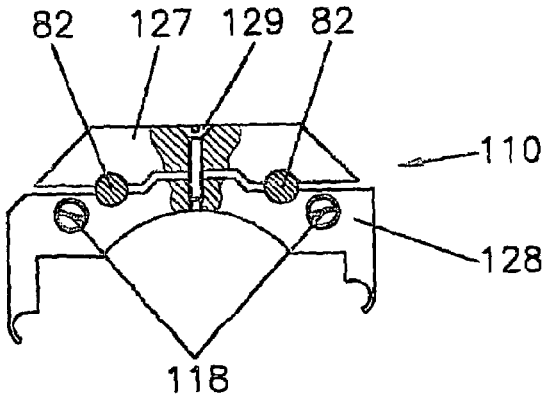
FIG. 26 projection according to XXVI—XXVI in FIG. 23.

As shown in FIG. 26, end stop plate 110 is bipartite. The upper part 127 and the lower part 128 are tensioned by a screw 129, thereby also fastening stop plate 110 on guide bars 82.

Figure 18:
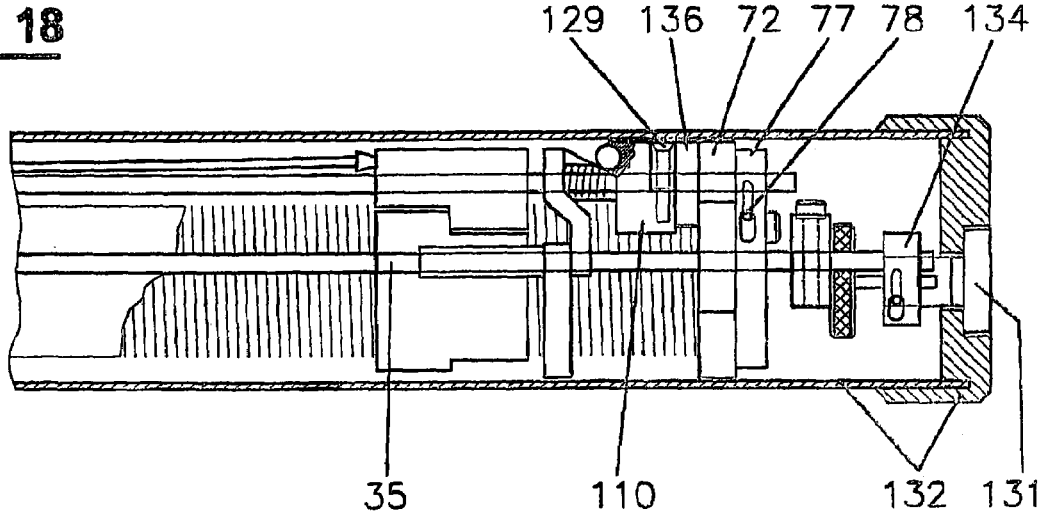
FIG. 18 view as in FIG. 17, however from the left.
Figure 19:
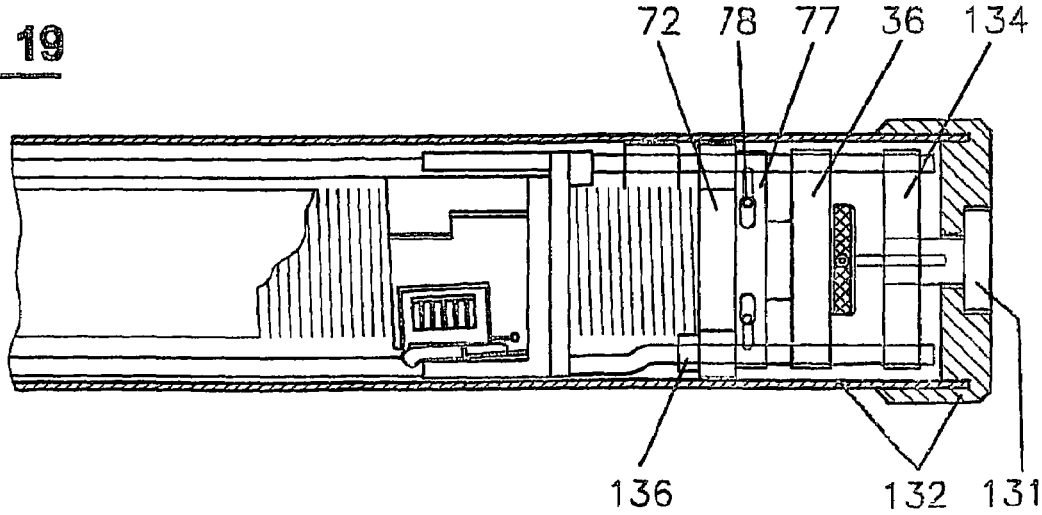
FIG. 19 view as in FIG. 17, however from the bottom.

With a maximum admissible length of rubber thread 7, the resting position of carriage 80, i.e. the position in which rubber thread 7 is fully wound up, is located very far at the rear of spool 60. However, this position must always keep a certain distance from brake support 116 to avoid that carriage 80 hits brake support 116 at this point already and thus activates the emergency brake as it moves past the rest position through the above-described dynamics at the end of the winding process. As a matter of fact, the emergency brake device is not self-releasing, i.e. when it is activated, the retrieval device must be opened and the brake released manually. Opening of the retrieval device is performed by loosening screw 131 that fastens enclosure 132, which simultaneously constitutes the handle surface of racket handle 3, to support plate 134. Support plate 134 is in turn clamped on longitudinal support bars 35 (FIGS. 17 to 19).

Figure 17:
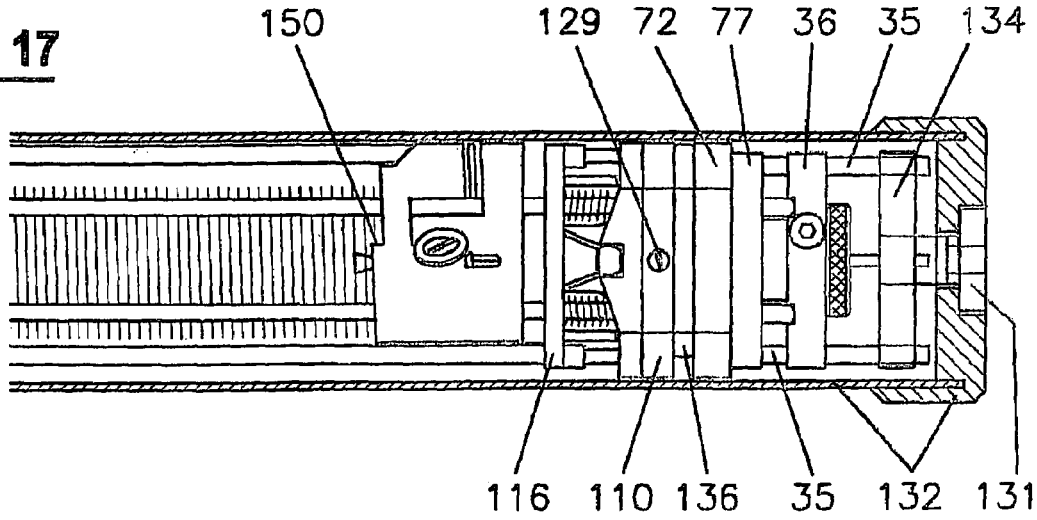
FIG. 17 enlarged top view of the handle of the tennis racket, opened.
Figure 27:
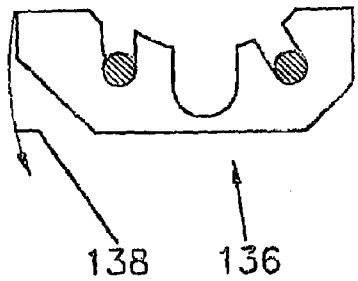
FIG. 27 projection of unlocking member according to XXVII—XXVII in FIG. 23.
Figure 28:
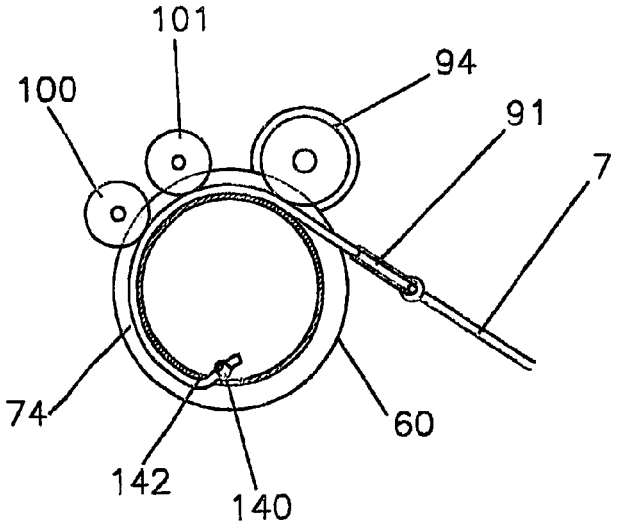
FIG. 28 cross-section through the spool at the location of the attachment hole for the thread element.

Releasing the emergency brake is effected by loosening screw 129 on stop plate 110 and pushing it to the rear, whereby the brake is released (FIG. 17). Since this would be impossible if stop plate 110 were in direct contact with rear bearing plate 72, a separator 136 is disposed between stop plate 110 and rear support plate 72. This separator 136 is removed as indicated by arrow 138 (FIG. 27), thus creating the required space for moving stop plate 110 away from brake support 116. Moving brake support 116 is not possible as brake pad 122 is firmly pressed on separating walls 76 and therefore a transversal movement is hardly For inserting a new rubber thread 7, carriage 80 is first moved to the foremost position. As shown in FIG. 28, the rubber thread is then slid onto spool 60 past deflecting pulley 91 between second roller 94 and bottom of groove 74. As appears in FIG. 15, a guiding tongue 139 is disposed at the back of roller 94, said tongue retaining the end of rubber thread 7 in helical groove 74 and guiding it underneath the following rollers of roller carriage 98. In the schematic illustration of FIG. 28, the inessential parts as well as guiding tongue 139 are not shown.

Behind the roller arrangements 100, 101, carriage 80 is opened by removing closure slide 86. The end of rubber thread 7 can be seized and simply provided with a knot 140 (FIG. 28). In the lower part of FIG. 28, the bottom of helical groove 74 is provided with an oblong hole 142 whose end located in the threading direction is enlarged to allow the insertion of knot 140. When rubber thread 7 is tensioned, the end with knot 140 is pulled towards the narrower part of oblong hole 142, whereby the end is fastened to spool 60.

Figure 29:
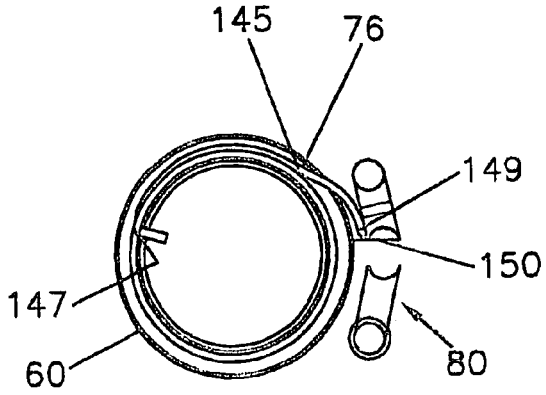
FIG. 29 cross-section through the spool at the spring stop.

A little further forward on spool 60, a spiral spring 145 is inserted in helical groove 74, one end of spiral spring 145 being bent inwards and engaging in a hole 147 in the bottom of helical groove 74, thereby fastening spiral spring 145. The other end 149 of spiral spring 145 is slightly bent upwards and slightly projects from separating wall 76. As appears in FIG. 29, this is sufficient for spring end 149 to act as a resilient stop for carriage 80. For this purpose, carriage 80 is provided on its front side with a step 150 (see FIG. 17) on which spring end 149 may act.

Figure 31:
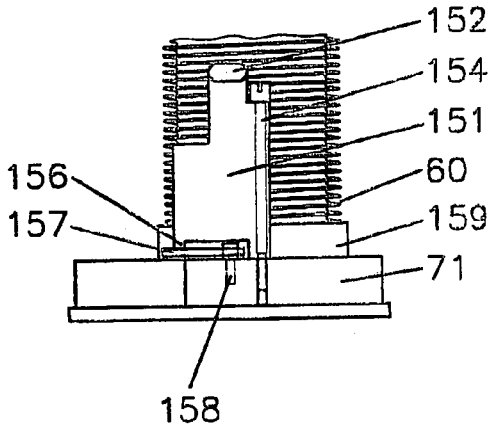
FIG. 31 schematic plan view of manual locking brake according to XXXI in FIG. 10.
Figure 30:
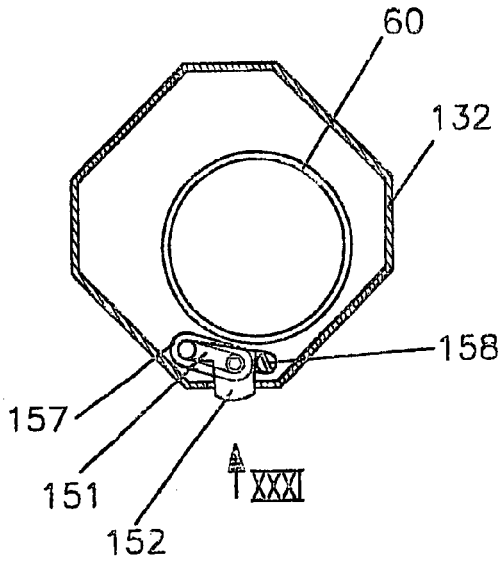
FIG. 30 cross-section through the racket handle according to XXX—XXX in FIG. 2.

At the beginning of a game, it is often required to make a kind of swinging movement while rubber thread 7 is completely wound up, e.g. when a ball is thrown up for a serve or when a ball that is rhythmically moved forward and back in an arc is played after having touched the ground, however without extending the rubber thread. For this purpose, a manually operated brake is disposed in the front part of the handle (FIGS. 30 and 31). It is composed of a rotationally arranged lever 151 on whose front end an outwardly projecting actuating tongue 152 is formed. Lever 151 is rotatable around a pivot 154 that is screwed into front bearing plate 71. In its rear section on the far side of the pivot, a projection 156 is formed. A simple rubber ring 157 is stretched between projection 156 and a pin 158. When pressing on actuating tongue 152 projecting from envelope 132, rubber ring 157 is pressed onto a brake ring 159 on spool 60, which is thus locked.

For left-handers, a second brake of this type may be provided in a mirror-image arrangement.

For a flawless operation of the ball retrieval device, it is necessary to ensure that the two sections 64, 65 in front and at the rear of driving pin 62 are equally tensioned in order to avoid that bearings 73 of spool 60 are subject to an axial load. To this end, the two knurled wheels 48, 52 are each rotated the same number of turns or fractions of turns, e.g. 8 to 10 turns each. By engagement of the locking pins 49, 53 in the respective knurled wheels 48, 52, knurled wheels 48, 52 are immovably held in their positions and the given initial tensions of rubber drive sections 64, 65 are maintained. given initial tensions of rubber drive sections 64, 65 are maintained.

From the preceding description of a preferred exemplifying execution, a large number of modifications will be apparent to those skilled in the art without leaving the protective scope of the invention as defined by the claims. Above all, it is conceivable to use the ball retrieval device for other ball games than tennis, in particular generally such games where a ball or another object is driven away by a swinging movement of a player with a striking, throwing or pitching instrument, e.g. for golf, baseball, but also for soccer.

The invention claimed is:

1. A ball retrieval device for ball games in which a playing ball is attached to a rubber-elastic thread element, wherein said rubber thread is retained in a thread storage device comprising the following parts:

a spool including a recovery element capable of being tensioned through rotation of the spool, a carriage that is movable in the longitudinal direction of the spool, including a device for guiding said thread element, and a driving device of the carriage that is operatively connected to said spool in order to move the carriage in synchronicity with the rotational movement of said spool, so that the thread element wound up on said spool is capable of being unwound while tensioning said recovery element and of being automatically rewound on said spool while untensioning said recovery element, the winding operation being controllable by said device for guiding, wherein said driving device is equipped with at least one driving roller extending into a helical recess, thereby allowing to produce, during the rotation of said spool, a longitudinal movement of said carriage in synchronicity with a pitch of said helical recess.

2. The ball retrieval device of claim 1, wherein said device for guiding comprises a deflecting arrangement providing a deflection of the course of said thread element from the tangential direction at an angle close to 90° with respect to the longitudinal axis of said spool for winding and unwinding, to a direction essentially parallel to the longitudinal axis of said spool, by means of at least one deflecting pulley.

3. The ball retrieval device of claim 1, wherein said helical recess has a width that essentially corresponds to the diameter of said thread element such that said thread element is capable of being inserted in said helical recess essentially without play.

4. The ball retrieval device of claim 1, wherein the bottom of said helical recess is essentially polyhedral in cross-section with straight or bent edges.

5. The ball retrieval device of claim 1, wherein bar-shaped guiding elements are arranged along said spool on which said carriage is smoothly displaceable, thereby allowing said spool to be moved to the current winding or unwinding location of said thread element on or from said spool with low resistance.

6. The ball retrieval device of claim 1, wherein at least one first driving roller is arranged such that it engages in a section of said helical recess containing no thread element, and a set of rollers composed of at least one second driving roller of a smaller diameter relative to said first driving roller, said second driving rollers being disposed above a section of said helical recess in which said thread element is wound up.

7. The ball retrieval device of claim 1, wherein a brake device for said spool is provided near at least one end position for said carriage, said brake device comprising a brake support and an impact element, said brake support comprising a brake element capable of being pressed on said spool and being displaceable relative to said impact element in the longitudinal direction of said spool, and said impact element comprising a pressure means in operational connection with said brake element such that when said carriage meets said brake support, the latter is movable towards said impact element, whereby said brake element is pressed onto said spool by the depression means in said impact element in order to brake said spool.

* * * * *